US009291432B2

(12) United States Patent
Fisher

(10) Patent No.: US 9,291,432 B2
(45) Date of Patent: Mar. 22, 2016

(54) FERRO ELECTRO MAGNETIC ARMOR

(75) Inventor: Michael L. Fisher, Granville, OH (US)

(73) Assignee: Battelle Memorial Institute, Columbus, OH (US)

( * ) Notice: Subject to any disclaimer, the term of this patent is extended or adjusted under 35 U.S.C. 154(b) by 267 days.

(21) Appl. No.: 13/818,332

(22) PCT Filed: Aug. 24, 2011

(86) PCT No.: PCT/US2011/048949
§ 371 (c)(1),
(2), (4) Date: Mar. 12, 2013

(87) PCT Pub. No.: WO2012/027460
PCT Pub. Date: Mar. 1, 2012

(65) Prior Publication Data

US 2013/0213211 A1 Aug. 22, 2013

Related U.S. Application Data

(60) Provisional application No. 61/376,338, filed on Aug. 24, 2010.

(51) Int. Cl.
*F41H 5/007* (2006.01)

(52) U.S. Cl.
CPC ..... *F41H 5/007* (2013.01)

(58) Field of Classification Search
CPC ..... F41C 11/04; F41H 5/007; F42B 3/006; F15B 15/19; B23D 15/145; C05D 5/04; C05D 5/06; H02N 2/183; F23Q 1/02; F23Q 3/002
See application file for complete search history.

(56) References Cited

U.S. PATENT DOCUMENTS 3,073,974 A 1/1963 Hoh et al.
3,441,940 A 4/1969 Salaman et al.
(Continued)

FOREIGN PATENT DOCUMENTS

FR 2 903 769 1/2008
GB 905 563 9/1962
(Continued)

OTHER PUBLICATIONS

Bedrin, A.G., et al., "Formation of a light-initiated surface discharge", Sov. Phys. Tech. Phys., 28(4):403-407, Apr. 1983.
(Continued)

*Primary Examiner* — Bret Hayes
(74) *Attorney, Agent, or Firm* — Frost Brown Todd LLC

(57) ABSTRACT

A gas producing device comprising a ferroelectric (FEG) or ferromagnetic (FMG) generator material wrapped by a conductor, wherein the conductor is in contact with a dielectric material. A ferroelectric or ferromagnetic generator material is polarized or magnetized. When a shock wave impacts the FEG or FMG, the polarization or magnetization of the material is rapidly destroyed. The rapid destruction of the magnet by breaking it into small pieces causes the magnetic field to go to zero very quickly. When the field changes quickly it induces a high current through the wrapped conductor or coil. When the current passes through the conductor in contact with the dielectric material it generates heat and vaporizes the dielectric material creating a high pressure gas. A reactive armor may comprise the gas producing device, wherein the high pressure gas moves one or more armor plates to defeat an anti-armor threat.

17 Claims, 3 Drawing Sheets

(56) References Cited

U.S. PATENT DOCUMENTS

| | | | | |
|---|---|---|---|---|
| 3,893,368 | A | 7/1975 | Wales, Jr. | |
| 3,922,968 | A | 12/1975 | Conger et al. | |
| 3,985,078 | A | 10/1976 | Hart et al. | |
| 4,299,169 | A * | 11/1981 | Weidner et al. | 102/210 |
| 4,347,790 | A * | 9/1982 | Lizen | 102/304 |
| 5,637,824 | A * | 6/1997 | Benyami | 89/36.17 |
| 6,619,181 | B1 * | 9/2003 | Frey et al. | 89/36.17 |
| 7,126,497 | B2 | 10/2006 | Face et al. | |
| 7,658,139 | B2 * | 2/2010 | Helander | 89/36.17 |
| 7,730,823 | B1 * | 6/2010 | Fullerton | 89/36.17 |
| 2004/0118273 | A1 * | 6/2004 | Zank | 89/36.17 |
| 2007/0221052 | A1 * | 9/2007 | Woodfin | 89/36.09 |
| 2009/0152989 | A1 * | 6/2009 | Baird et al. | 310/339 |
| 2009/0256447 | A1 | 10/2009 | Baird et al. | |
| 2011/0037327 | A1 * | 2/2011 | Denne | H02K 41/03 310/12.16 |

FOREIGN PATENT DOCUMENTS

| | | |
|---|---|---|
| GB | 1 125 850 | 9/1968 |
| GB | 2 329 233 | 3/1999 |
| WO | WO 2010/082970 | 7/2010 |

OTHER PUBLICATIONS

Hammer, D.A., et al., "Single-wire explosion experiments relevant to the initial stages of wire array z pinches," Laser and particle Beams (2001), 19:377-391.

Holt, S.L., et al., "Characterization of Explosively Driven Ferroelectric Generator Material," Magagauss magnetic field generation and related topics, 2006 IEEE International Conference on , Nov. 5-10, 2006, pp. 307-312.

O'Conner, K.A., et al., "Analysis of Plasma Antenna Options for Explosively-Drive Microwave Generators and Outline of Plasma Antenna Design," Power Modulator Symposium, 2006. Conference Record of the 2006 Twenty-Seventh International, pp. 380-384.

Tkach, Y., et al., "Explosive Driven Ferroelectric Generators," Pulsed Power Plasma Science, 2001. PPPS-2001. Digest of Technical Papers, pp. 986-989, vol. 2.

International Search Report dated Oct. 6, 2011 for Application No. PCT/US2011/048949.

English Abstract and Machine Translation of French Patent FR 2 903 769.

* cited by examiner

FERRO ELECTRO MAGNETIC ARMOR

CROSS REFERENCE TO RELATED APPLICATIONS

The present application hereby claims the benefit of PCT/US2011/048949, filed on Aug. 24, 2011, which claimed benefit of the provisional patent application of the same title, Ser. No. 61/376,338, filed on Aug. 24, 2010, the disclosure of which is hereby incorporated by reference in its entirety.

BACKGROUND

Electromagnetic Armor, EMA, has been shown to defeat shaped charge jets and other anti-armor threats, Typical EMA has an energy storage device, typically a capacitor(s), connected electrically in series with a set of spaced plates or rails. The anti-armor threat acts as the electrical switch for the energy storage device, discharging the energy, in the form of an electric current, electric and magnetic fields, through the anti-armor threat. The electrical energy then disrupts the shaped charged jet by Joule heating the anti-armor threat, inciting magneto-hydrodynamic instabilities in the shaped charge jet, or exciting inherent plastic instabilities in the shaped charge jet through capillary waves on the jet surface. The electrical energy may also introduce large Lorentz forces on the anti-armor threat by judicious geometry design of the rails and/or plates. This Lorentz force drives capillary waves on the shaped charge jet and will induce rotation in other anti-armor threats.

Explosive Reactive Armor, ERA, is also effective against anti-armor threats. ERA consists of two parallel plates of armor sandwiched about a shock sensitive explosive. The plates are oriented such that the surface normal to the front plate is at an oblique angle to the shot line of the anti-armor threat. A shock wave is sent through the front plate, into the explosive sandwich as the anti-armor threat strikes the front plate. The shock sensitive explosive is initiated and rapidly undergoes complete detonation. The chemical energy released during the detonation process causes the two armor plates to move apart, roughly parallel to the surface normal and obliquely to the anti-armor threat shot line. The result is that relatively thin armor plates greatly disrupt shaped charge jets and cause large rotations and even fracture of other types of anti-armor threats.

BRIEF SUMMARY

A gas producing device comprising a ferroelectric or ferromagnetic generator material wrapped by a conductor, wherein the conductor in contact with a dielectric material.

A gas producing device comprising a ferroelectric or ferromagnetic generator material, a conductor, and a dielectric material, wherein the conductor is wrapped around the ferroelectric or ferromagnetic generator material so that upon a hard impact, the current generated by the depolarization of the ferroelectric or ferromagnetic generator material is transmitted to the dielectric material whereby the dielectric material is vaporized.

A method for rapidly generating gas comprising the steps of:

a) depolarizing a ferroelectric or ferromagnetic generator material, whereby the depolarized ferroelectric or ferromagnetic generator material produces a current; and
b) the current generates heat in a dielectric material, whereby the dielectric material is vaporized.

A reactive armor comprising a gas producing device comprising a ferroelectric (FEG) or ferromagnetic (FMG) generator material wrapped by a conductor, wherein the conductor is in contact with a dielectric material.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
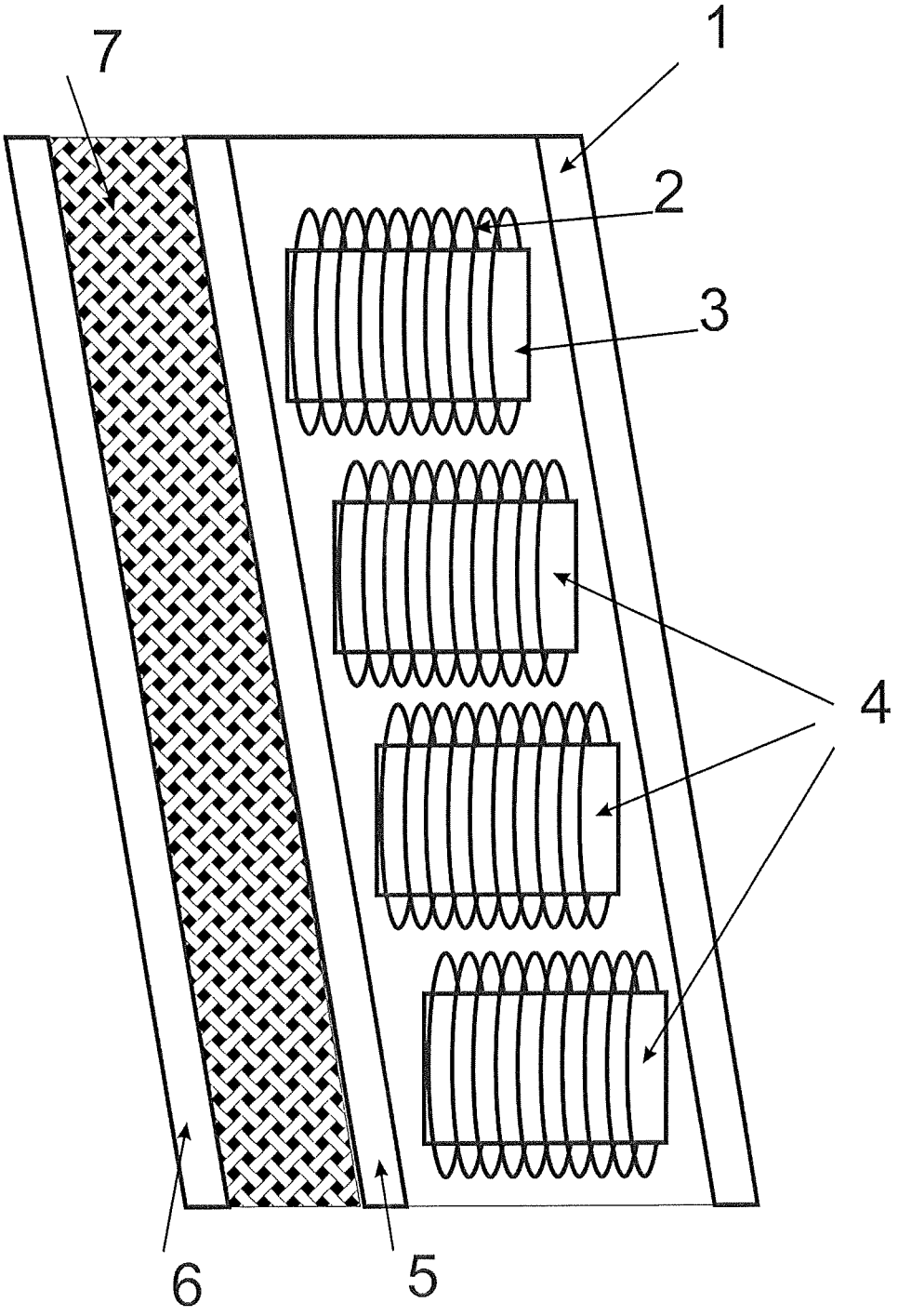
FIG. 1 is a schematic of a reactive armor showing ferromagnetic generator material, a dielectric, and armor plates. Nuisance armor protective panel 1 is to prevent the FEMA module from functioning for a lesser threat than designed, e.g., FEMA to defeat rocket propelled grenade, and nuisance armor protective panel 1 could be armor to defeat 0.50 caliber anti-personal threats. Conductor 2 surrounds the hard ferromagnet 3, which together are a FEMA current generator. Additional FEMA current generators 4 may be arranged as needed to provide adequate threat coverage. Forward flying armor plate 5. Backward flying armor plate 6. dielectric 7, with conducting paths imbedded.

A gas producing device comprising a ferroelectric (FEG) or ferromagnetic (FMG) generator material wrapped by a conductor, wherein the conductor is in contact with a dielectric material. A ferroelectric or ferromagnetic generator material is polarized or magnetized. When a shock wave impacts the FEG or FMG, the polarization or magnetization of the material is rapidly destroyed. The rapid destruction of the magnet by breaking it into small pieces causes the magnetic field to go to zero very quickly. When the field changes quickly it induces a high current through the wrapped conductor or coil. When the current passes through the conductor in contact with the dielectric material it generates heat and vaporizes the dielectric material creating a high pressure gas.

The FEG or FMG materials are ones that have a natural or induced polarization or magnetization. Upon impact or a shock wave, the FEG or FMG materials will lose their polarization or magnetization. The materials may fracture, disintegrate, or undergo a phase transition. For materials that fracture it is beneficial that they be brittle. FMG materials are hard ferromagnetic materials with a high flux. Examples of FEG and FMG materials are lead zirconate titanate ($Pb(Zr_{52}Ti_{48})O_3$, neodymium iron boride ($Nd_2Fe_{14}B$), ceramics, alnico, and samarium cobalt.

Ceramic, also known as ferrite, magnets are made of a composite of iron oxide and barium or strontium carbonate. These materials are readily available and at a lower cost than other types of materials used in permanent magnets. Ceramic magnets are made using pressing and sintering. These magnets are brittle and require diamond wheels if grinding is necessary. These magnets are also made in different grades. Ceramic-1 is an isotropic grade with equal magnetic properties in all directions. Ceramic grades 5 and 8 are anisotropic grades. Anisotropic magnets are magnetized in the direction of pressing. The anisotropic method delivers the highest energy product among ceramic magnets at values up to 3.5 MGOe (Mega Gauss Oersted). Ceramic magnets have a good balance of magnetic strength, resistance to demagnetizing and economy. They are the most widely used magnets today.

Alnico magnets are made up of a composite of aluminum, nickel, and cobalt, with small amounts of other elements added to enhance the properties of the magnet. Alnico magnets have good temperature stability, good resistance to demagnetization due to shock but they are easily demagnetized. Alnico magnets are produced by two typical methods, casting or sintering. Sintering offers superior mechanical characteristics, whereas casting delivers higher energy products (up to 5.5 MGOe) and allows for the design of intricate shapes. Two very common grades of Alnico magnets are 5 and 8. These are anisotropic grades and provide for a preferred direction of magnetic orientation.

Samarium cobalt is a type of rare earth magnet material that is highly resistant to oxidation, has a higher magnetic strength and temperature resistance than alnico or ceramic material. Samarium cobalt magnets are divided into two main groups: $Sm_1Co_5$ and $Sm_2Co_{17}$ (commonly referred to as 1-5 and 2-17). The energy product range for the 1-5 series is 15 to 22 MGOe, with the 2-17 series falling between 22 and 32 MGOe. These magnets offer the best temperature characteristics of all rare earth magnets and can withstand temperatures up to 300° C. Sintered samarium cobalt magnets are brittle and prone to chipping and cracking and may fracture when exposed to thermal shock. Due to the high cost of the material samarium, samarium cobalt magnets are used for applications where high temperature and corrosion resistance is critical.

Neodymium iron boron (NdFeB) is another type of rare earth magnetic material. This material has similar properties as the samarium cobalt except that it is more easily oxidized and generally doesn't have the same temperature resistance. NdFeB magnets also have the highest energy products approaching 50MGOe. These materials are costly and are generally used in very selective applications due to the cost. Their high energy products lend themselves to compact designs that result in innovative applications and lower manufacturing costs. NdFeB magnets are highly corrosive. Surface treatments have been developed that allow them to be used in most applications. These treatments include gold, nickel, zinc and tin plating and epoxy resin coating.

Dielectric material will resist the flow of electric current and generate heat. When exposed to high current the dielectric material will be vaporized to a gas. In one embodiment the dielectric materials are long chain polymers that are stabilized with hydroxyl groups at least on one end. Examples of dielectrics are poly(methyl methacrylate), polypropylene, polyurethane, polyethylene, and polyoxymethylenes.

Polyoxymethylenes, also known as POMs, are notable for their high degree of crystallinity, which gives them: high strength, stiffness and hardness, good chemical and environmental resistance and low moisture absorption. POM is classified as acetal copolymer. It may be processed by injection molding, extrusion, compression molding, rotational casting or blow molding.

The conductor is something in which electric current or voltage may be induced upon the change of a local polarization or magnetization. The conductor may be wrapped in a coil around the FEG or FMG material. The conductor may be wrapped around the ferroelectric or ferromagnetic generator in a manner that the enclosed magnetic flux is parallel or near parallel to the normal vector component of the area encompassed by the windings. The wrapping may be multiple times, or a single time. Examples of a conductor are a copper, aluminium, silver, or gold wire.

The conductor is in contact with a dielectric material, the contact may be on the surface, or it may be surrounded by the dielectric material. The conductor may be a conducting mesh, a foil, or a wire. The conductor makes contact with the dielectric material which allows it to heat up and vaporize when the current passes through the conductor.

In one embodiment, a reactive armor may comprise a gas producing device comprising a ferroelectric (FEG) or ferromagnetic (FMG) generator material wrapped by a conductor, wherein the conductor is connected to a conducting mesh in a dielectric material. The reactive armor may comprise two or more armor plates on opposite sides of the gas producing device, or the dielectric material. In one embodiment, the reactive armor comprises a single armor plate. A shock wave may be produced by the impact of an anti-armor threat on the reactive armor. When the shock wave impacts the FEG or FMG, the polarization or magnetization of the material is rapidly destroyed, inducing a high current through the wrapped conductor or coil. When the current passes through the conducting mesh in a dielectric material, it vaporizes the dielectric material generating a high pressure gas. The high pressure gas moves one or more armor plates. The movement of the armor plates can be used to defeat an anti-armor threat. The plates may move apart, roughly parallel to the surface normal and obliquely to the anti-armor threat shot line. The result is that relatively thin armor plates greatly disrupt shaped charge jets and cause large rotations and even fracture of other types of anti-armor threats.

In one embodiment, the armor plates comprise ceramic materials. In another embodiment, the armor plates comprise metals, metal alloys, or composite materials such as hard, semi-hard, or soft fiber-resin plates or fabrics. In another embodiment, the armor plates comprise glass or glass-like materials. Examples include plate glass and borosilicate glass. Glass like materials may be metallic glass, or amorphous metal.

In one embodiment the reactive armor is oriented at an angle to the line-of-sight direction of an anti-armor threat.

In one embodiment, a reactive armor may comprise a gas producing device comprising a ferroelectric (FEG) or ferromagnetic (FMG) generator material wrapped by a conductor, wherein the conductor is connected to a conducting mesh in a dielectric material. The reactive armor comprises a ceramic plate wherein the ceramic armor plate is confined by the high pressure gas produced by the gas producing device. Ceramic is an effective armor material for anti-armor threats, but by confining the ceramic its performance at stopping anti-armor threats improves.

In one embodiment, when one or more of the armor plates move under the influence of the high pressure gas, the armor plates move across the line-of-sight of the anti-armor threat, imparting a force vector anti-parallel to the anti-armor threat's velocity vector. This force may cause the threat to tumble and not pose a threat to the armor.

In one embodiment, when one or more of the armor plates move under the influence of the high pressure gas, the armor plates move across the line-of-sight of the anti-armor threat, continually presenting undisturbed material into the line-of-sight of the anti-armor threat. By presenting undisturbed material to the line-of-sight of the anti-armor threat, the armor will create the appearance of thicker armor to the anti-armor threat. The anti-armor threat will need to cut through more armor before it is possible to penetrate it.

In one embodiment, when one or more of the armor plates move under the influence of the high pressure gas, the armor plates move across the line-of-sight of the anti-armor threat, disrupting the structural integrity of the anti-armor threat. By disrupting the structural integrity of the anti-armor threat the threat may be broken up, destroying the threat.

One embodiment is a method for rapidly generating gas comprising the steps of: a) depolarizing a ferroelectric or ferromagnetic generator material, whereby the depolarized ferroelectric or ferromagnetic generator material produces a current; and b) passing the current through a dielectric material, whereby the dielectric material is vaporized by the current.

In one embodiment, the method for rapidly generating gas is used to defeat an anti-armor threat. The method comprises the steps of: an anti-armor threat hitting a reactive armor, which initiates the method for rapidly generating gas; and the gas produced causes at least one armor plate to move. The armor plates move apart, roughly parallel to the surface normal and obliquely to the anti-armor threat shot line. The result is that relatively thin armor plates greatly disrupt shaped charge jets and cause large rotations and even fracture of other types of anti-armor threats. The movement of the armor plate may impart a force vector anti-parallel to the anti-armor threat's velocity vector; causes undisturbed armor material to be continually presented into the line-of-sight of the anti-armor threat; or disrupts the structural integrity of the anti-armor threat.

Reactive armor may be safer than explosive reactive armor because the armor does not explode, consequently people located near the armor when it is hit by an anti-armor threat will less likely to be injured by the armor. The reactive armor is always on, and less sensitive to nuisance threats.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

EXAMPLES

Prophetic Example

An anti-armor threat approaches the FEMA module from the right in FIG. 1. The threat penetrates the nuisance armor protection, striking a FEMA current generator. The threat destroys the hard ferro-magnet in the FEMA current generator. Upon destruction of the ferro-magnet the permanent magnetic flux diminishes rapidly to zero. This change in flux causes a current to flow in the surrounding conductor. The current is fed to the conducting path embedded within the dielectric, causing the dielectric to vaporize, producing high pressure gas. The high pressure gas causes the armor flyer plates to move in a direction non-parallel to the threat, interacting with the threat and destroying the threat.

FEMA Current Generator Example

Figure 2:
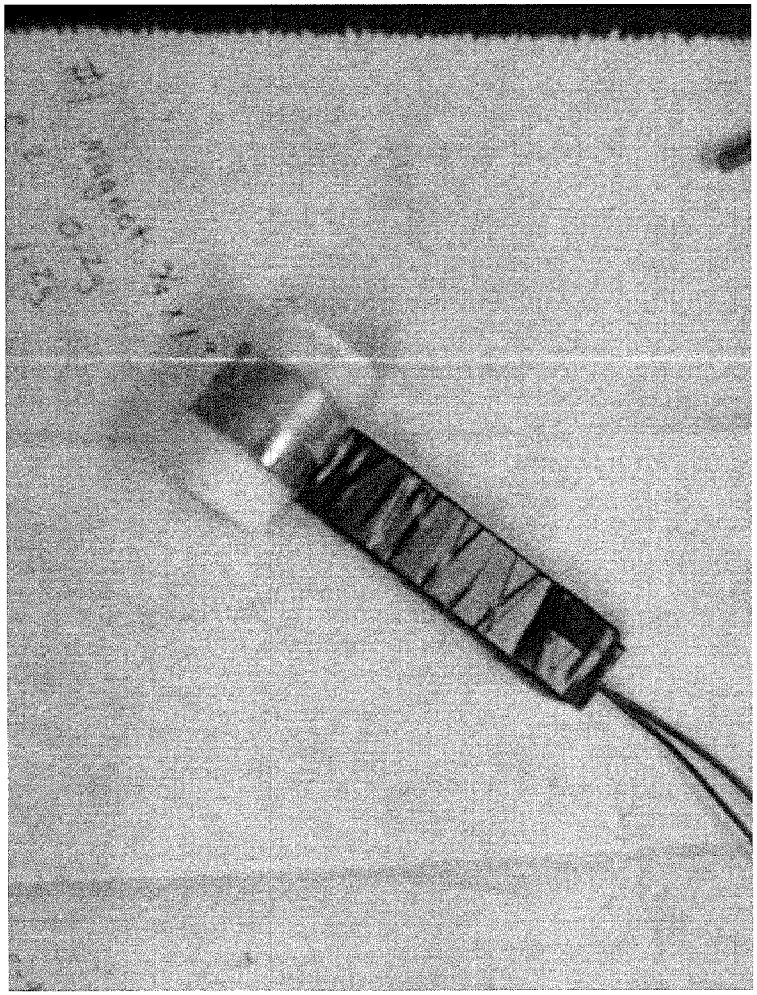
FIG. 2 is a photograph of a FEMA current generator.

A typical FEMA current generator is shown in FIG. 2. Thin Copper tape surrounds the hard ferro-magnet in this instance. The current leads can be seen in the upper right portion of the photograph.

Figure 3:
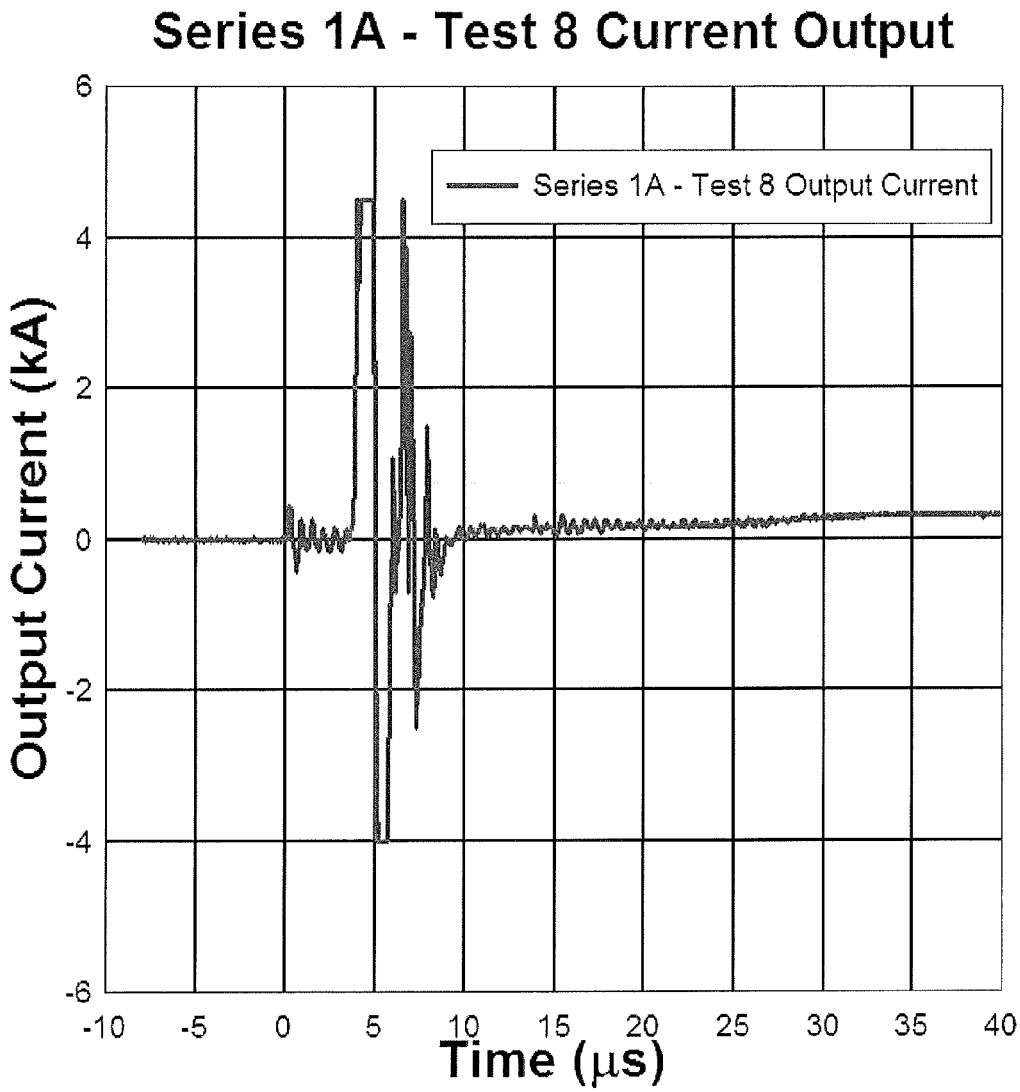
FIG. 3 is the current profile of the FEMA current generator example.

The current leads were then connected to an electrical load. The hard ferro-magnet was destroyed and the resultant current in the FEMA current generator was measured. A typical current profile for the functioning of a FEMA current generator is shown in FIG. 3.

What is claimed is:

1. A gas producing device comprising a ferroelectric or ferromagnetic generator material wrapped by a conductor, wherein the conductor is also in contact with a dielectric material, wherein the ferroelectric or ferromagnetic generator material produces a magnetic flux, wherein the conductor is wrapped around the ferroelectric or ferromagnetic generator material in a manner that an enclosed magnetic flux is parallel or near parallel to a normal vector component of an area encompassed by the wrapped conductor.

2. The device of claim 1, wherein the ferroelectric or ferromagnetic generator material is selected from lead zirconate titanate and neodymium iron boride.

3. The device of claim 1, wherein the dielectric is selected from poly(methyl methacrylate), polypropylene, polyurethane, polyethylene, and polyoxymethylenes.

4. The device of claim 1, wherein the conductor is a wire.

5. A reactive armor that comprises the device of claim 1.

6. The reactive armor of claim 5, wherein the armor comprises two armor plates on opposite sides of the gas producing device.

7. The reactive armor of claim 6, wherein the conductor is wrapped around the ferroelectric or ferromagnetic generator material so that upon a hard impact the ferroelectric or ferromagnetic generator material is depolarized, the current generated by the depolarization of the ferroelectric or ferromagnetic generator material is transmitted to the dielectric material whereby the dielectric material is vaporized, producing a high pressure gas.

8. The reactive armor of claim 7, wherein one or both of the armor plates are able to move under the influence of the high pressure gas produced upon the hard impact.

9. The reactive armor of claim 7, wherein when the hard impact is caused by an anti-armor threat one or both of the armor plates move under the influence of the high pressure gas, one or both of the armor plates move across the line-of-sight of the anti-armor threat, imparting a force vector anti-parallel to the anti-armor threat's velocity vector.

10. The reactive armor of claim 7, wherein when the hard impact is caused by an anti-armor threat one or both of the armor plates move under the influence of the high pressure gas, one or both of the armor plates move across the line-of-sight of the anti-armor threat, continually presenting undisturbed material into the line-of-sight of the anti-armor threat.

11. The reactive armor of claim 7, wherein when the hard impact is caused by an anti-armor threat one or both of the armor plates move under the influence of the high pressure gas, one or both of the armor plates move across the line-of-sight of the anti-armor threat, disrupting the structural integrity of the anti-armor threat.

12. The reactive armor of claim 7, wherein the armor comprises a ceramic armor plate, wherein the ceramic armor plate is confined by the high pressure gas.

13. The reactive armor of claim 5, wherein the armor comprises at least one ceramic armor plate.

14. The reactive armor of claim 5, wherein the armor comprises a ceramic armor plate, wherein the ceramic armor plate is confined by the gas produced by the gas producing device.

15. The reactive armor of claim 5, wherein the armor comprises a glass armor plate, wherein the glass armor plate is confined by the gas produced by the gas producing device.

16. A method for rapidly generating gas comprising the steps of:

a) providing a device comprising a ferroelectric or ferromagnetic generator material wrapped by a conductor, wherein the conductor is also in contact with a dielectric material, wherein the ferroelectric or ferromagnetic generator material produces a magnetic flux, wherein the conductor is wrapped around the ferroelectric or ferromagnetic generator in a manner that the enclosed magnetic flux is parallel or near parallel to the normal vector component of the area encompassed by the wrapped conductor;

b) depolarizing a ferroelectric or ferromagnetic generator material, whereby the depolarized ferroelectric or ferromagnetic generator material produces a current; and c) the current generates heat in a dielectric material, whereby the dielectric material is vaporized.

17. A method of defeating an anti-armor threat comprising the steps of:

an anti-armor threat hitting a reactive armor, whereby the impact depolarizes a ferroelectric or ferromagnetic generator material, whereby the depolarized ferroelectric or ferromagnetic generator material produces a current; and the current generates heat in a dielectric material, whereby the dielectric material is vaporized producing a high pressure gas; and the gas produced causes at least one armor plate to move the anti-armor threat.

* * * * *